United States Patent [19]

Swedberg

[11] 3,930,766

[45] Jan. 6, 1976

[54] RADIAL BALANCING MEANS FOR A HYDRAULIC DEVICE

[75] Inventor: Nils Einar Swedberg, Chanhassen, Minn.

[73] Assignee: Eaton Corporation, Ohio

[22] Filed: Dec. 9, 1974

[21] Appl. No.: 530,638

Related U.S. Application Data

[63] Continuation-in-part of Ser. No. 357,421, May 4, 1973, abandoned.

[52] U.S. Cl. ..... 418/61 B; 418/125

[51] Int. Cl.[2] ..... F01C 1/02; F03C 3/00; F04C 1/02

[58] Field of Search ..... 418/61 B, 124, 125, 166, 418/171, 225

[56] References Cited

UNITED STATES PATENTS

| | | | |
|---|---|---|---|
| 3,389,618 | 6/1968 | McDermott | 418/61 B |
| 3,591,320 | 7/1971 | Woodling | 418/61 B |
| 3,680,987 | 8/1972 | Ohrberg | 418/61 B |
| 3,692,439 | 9/1972 | Woodling | 418/61 B |

*Primary Examiner*—John J. Vrablik
*Attorney, Agent, or Firm*—Teagno & Toddy

[57] ABSTRACT

An improved radial, pressure-balancing arrangement for fluid-operated devices of the geroter type wherein an externally-toothed star member is eccentrically disposed within an internally-toothed ring member to form a plurality of expanding and contracting volume chambers by tooth interaction. The ring member has a plurality of pockets receiving a like number of rollers rotatable therein which define the teeth of the ring member. Particularly configured recesses are located at predetermined positions within each pocket. The recesses are effective to provide a predetermined pressure pattern behind a selective roller at any particular time during the operation cycle. The pressure pattern thus formed biases the selective roller against a mating star tooth to seal volume chambers at high pressure from those at low pressure.

6 Claims, 5 Drawing Figures

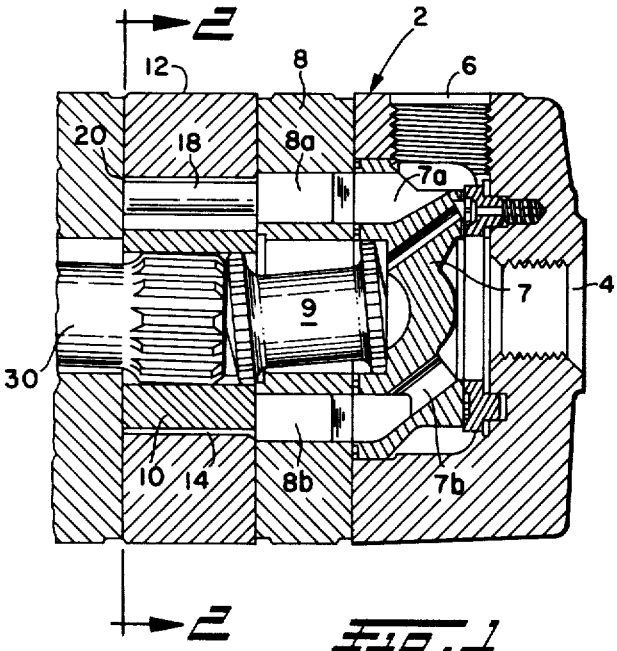
Fig. 1
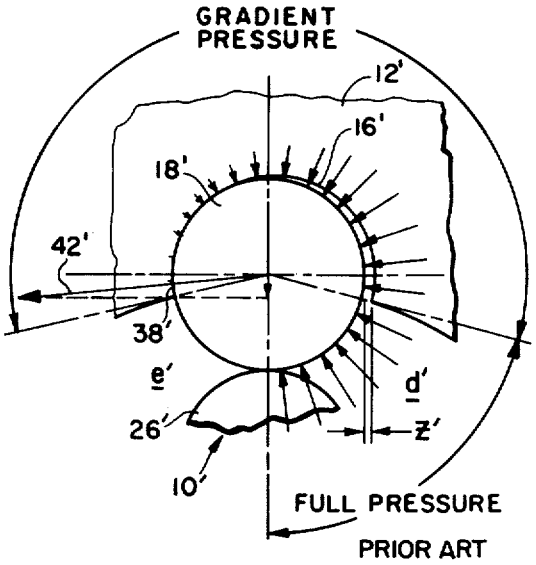
Fig. 5
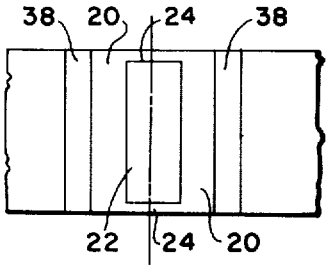
Fig. 3
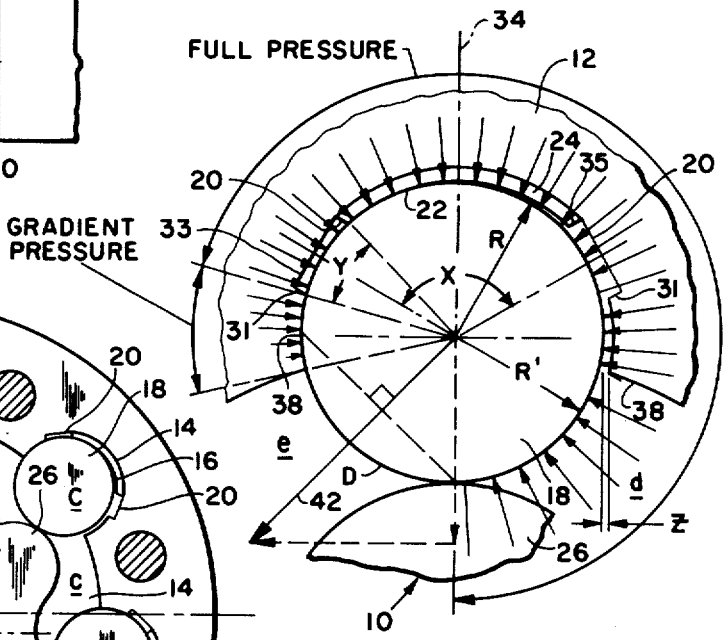
Fig. 4
Fig. 2
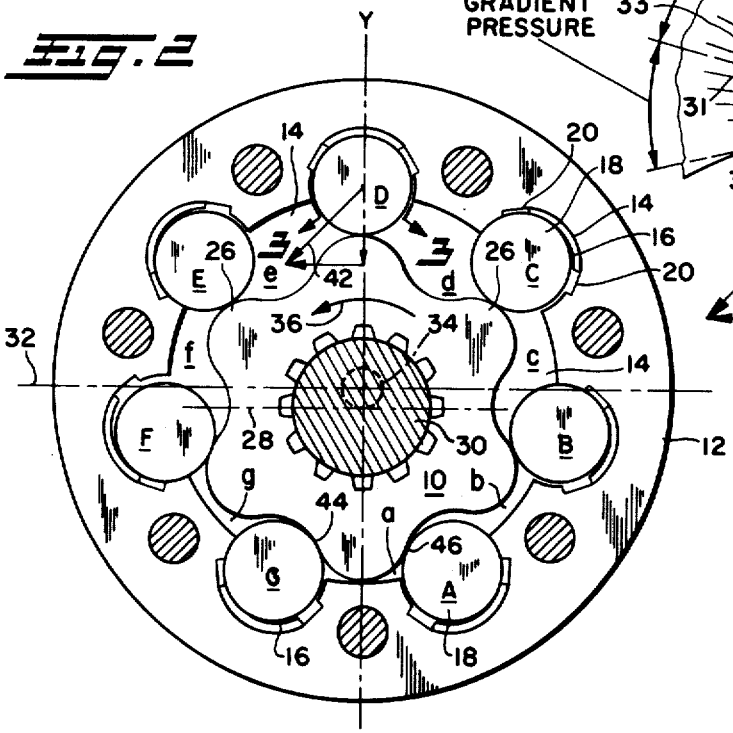

RADIAL BALANCING MEANS FOR A HYDRAULIC DEVICE

CROSS-REFERENCE TO RELATED APPLICATION

This application is a continuation-in-part of my copending application Ser. No. 357,421, filed May 4, 1973 and now abandoned.

BACKGROUND OF THE DISCLOSURE

This invention relates to hydraulic devices of the geroter type and more particularly to a pressure-balancing arrangement for geroter type devices employing rollers as teeth of one of the displacement members therein.

Hydraulic devices of the type commonly referred to as geroters comprise an internally-toothed ring member eccentrically receiving an externally-toothed star member. The star member usually has one less tooth than the ring member to define a number of volume chambers which expand and contract upon one member's hypocycloidal movement about the axis of the other. To maintain volumetric efficiency within such devices, leakage between volume chambers at high pressure and those at low pressure must be minimized. Thus the fit between mating teeth is critical and the teeth of one member must be precisely formed to provide an accurate fit with the teeth of the other member. When the teeth wear, clearance between the members becomes excessive and leakage with resultant inefficiency occurs.

The prior art has attempted to overcome the problems associated with the close fit between the ring member and star member by forming the teeth of the ring member from cylindrical rollers rotatably positioned in pockets formed in the ring member. Geroter gear sets utilizing rollers as the teeth of the ring member may be classified, or distinguished, by the relationship, for each particular geroter set, between the roller diameter and pocket diameter, as well as by the relationship between the "tangent circle" of the ring-roller assembly (i.e., a circle tangent to the inner peripheries of the rollers centered within their respective pockets) and the "average diameter" of the star member (i.e., the average of the major and minor diameters of the star member).

Thus, a geroter set is referred to as having an "interference fit". When each of the rollers has substantially a bearing fit with its respective pocket (i.e., a diametral clearance between the roller and pocket of less than about .0015 inches (.038 mm) ), and the average diameter of the star member "interferes" with the tangent circle of the ring roller assembly (i.e., the average diameter is larger than the tangent circle by as much as about .0010 inches (.025 mm), or more). In such a geroter set, the interference fit precludes any biasing or inward radial movement of the rollers.

A geroter set is referred to as having a "non-interference fit" when each roller has a bearing fit with its respective pocket, as in the case of the interference fit, but there is a clearance between the average diameter of the star member and the tangent circle of the ring-roller assembly (i.e., the average diameter is dimensionally larger than the tangent circle by about .0010 inches (.025 mm), or more). In a geroter set having a non-interference fit, radial movement or biasing of the rollers is possible because of the clearance between the average diameter and the tangent circle.

A geroter set is referred to as having a "loose fit" when each roller and its respective pocket have more diametral clearance than the running clearance attributable to a bearing fit relationship. Typically, with a loose fit geroter set there is a diametral clearance between each roller and its respective pocket of about .003 inches (.076 mm) to about .005 inches (.127mm). With the rollers loosely received in the pockets, the relationship of the average diameter and the tangent circle is less critical and there may be a nominal interference between the average diameter and the tangent circle, although, typically, a clearance is provided.

Therefore, because the present invention relates to biasing of the rollers, it will be understood by those skilled in the art that the invention would be advantageous only when utilized with a geroter set having a non-interference fit or with a geroter set having a loose fit, and, preferably, with a geroter set having a non-interference fit to minimize leakage problems.

Among the prior art methods of biasing the rollers inward into the sealing contact with the star member, one known balancing arrangement taps high pressure from a source, such as the valving or one of the volume chambers, and directs it constantly to the pocket behind the roller. With such an arrangement, volumetric efficiency is seriously reduced because of constant leakage which occurs when the rollers remain continuously biased by fluid at high pressure.

It is thus a principal object of the subject invention to provide a hydrostatic pressure biasing arrangement for rollers used as chamber-forming elements in a geroter type device, which arrangement is operable to control the magnitude and direction of the force applied to the rollers to fully balance the geroter arrangement by use of pressure from adjacent chambers while also providing means to support the rollers in their proper geometric arrangement with respect to the teeth of the star member.

In accordance with the invention, there is provided a geroter comprising a roller-type, internally-toothed ring member eccentrically receiving an externally-toothed star member having fewer teeth to define a plurality of volume chambers. Each roller in the ring member is rotatably disposed within a pocket of diameter slightly greater than that of the roller. Each pocket has a plurality of recesses formed therein which are separated from one another by a roller support surface or land and communicated with one another by grooves or depressed areas extending around or through the support surfaces.

The recesses are particularly configured and positioned to develop a controlled, essentially hydrostatic, pressure pattern biasing the roller toward the corresponding star tooth when the roller is positioned between chambers at high and low pressures. The pressure pattern is characterized by being symmetrically distributed over a portion of the pocket to produce a controlled, resultatnt force directed radially-inwardly and of sufficient magnitude to adequately seal high pressure chambers from low pressure chambers.

Additionally, the roller support surfaces maintain the rollers in their proper geometric relationship even though the recesses provide an "excessive clearance" necessary to establish a sufficient resultant force.

It is thus an object of the subject invention to provide high volumetric efficiency in a fluid-operated device of the geroter type even though tooth contact wear has occurred.

Yet another object of the invention is to provide pressure-balancing means in a fluid-operated device of the geroter type acting in a substantially-radial direction and exerting a predetermined resultant force between the teeth of the ring and star members to effectively seal high pressure chambers from low pressure chambers therein.

Still other objects of the invention reside in a radial, pressure-balancing arrangement employed in fluid-operated devices of the geroter type which provides a high starting torque and a compensation for pressure deflection.

The invention may take physical form in certain parts and an arrangement of parts, a preferred embodiment of which will be described in detail herein and illustrated in the accompanying drawings which form a part hereof and wherein:

FIG. 1 is a sectional view of a geroter device employing the subject invention;

FIG. 2 is an axial end view of the star and ring members taken along Line 2—2 of FIG. 1;

FIG. 3 is a developed view of a roller-pocket taken along Line 3—3 of FIG. 2;

FIG. 4 is an enlarged end view of a roller applied within a pocket; and

FIG. 5 is a view similar to FIG. 4 showing a prior art construction.

DESCRIPTION OF THE PREFERRED EMBODIMENT

The basic configuration of the geroter device shown in FIG. 1 to which this invention relates is well known in the fluid transmission art and may be appreciated in greater detail than will be described herein by reference to U.S. Pat. No. 3,572,983 to McDermott.

Referring now to the drawings wherein the showings are for the purpose of illustrating a preferred embodiment of the invention only and not for the purpose of limiting same, there is generally shown in FIG. 1 a housing 2 having inlet and outlet ports 4,6 communicating through ports 7*a* and 7*b* in a rotatable valve member 7 with flow ports 8*a* and 8*b*, respectively in a port plate 8 to define a known commutator-type valving arrangement. The valve member is connected by a splined shaft member 9 for driving rotation with an externally-toothed star member 10. Housing 2 also includes a ring member 12 eccentrically receiving the star member 10 to define a plurality of increasing and decreasing volume chambers 14 in communication at one axial end with port plate 8. Ring member 12 has a plurality of pockets 16 axially-extending therethrough, each of which receive a cylindrical roller 18 rotatably disposed therein. Each pocket is semi-cylindrical and configured to define axially-extending recesses 20 spaced from one another by a roller support surface 22 and communicating with one another by grooves or depressed areas 24 extending around support surface 22.

Referring now to FIG. 2 there is shown a ring member 12 having a plurality of N roller teeth 18 and a star member 10 having a plurality of N-1 teeth 26. In the embodiment illustrated the designation "N" refers to the number 7 and correspondingly "N-1" refers to the number 6. Ring member 12 eccentrically receives the star member 10 and the eccentricity of the arrangement is shown as the distance between the ring axis 32 and the star axis 28. Circumferentially-spaced and opening to the internal periphery of the ring member 12, are N semi-cylindrical, axially-extending pockets 16. Each pocket 16 is adapted to rotatably receive a cylindrical roller 18, each different roller individually lettered "A" through "G". Rollers 18 interact with the star teeth 26 to form variable volume chambers 14 which are individually identified by letters *a* through *g*.

As thus described, the star and ring members 10,12 will interact with one another in the usual manner. More particularly with the ring member 12 fixed from rotating, the star member 10 will orbit hypocycloidally within the ring member 12 whereby the star center defines a circle 34 about the ring center, of radius equal to the eccentricity of the device. This movement of the star member opens and closes volume chambers *a* through *g* while the star member rotates a peripheral distance equal to one tooth spacing.

More particularly the commutator valving will supply high pressure to three chambers and low pressure to three chambers with the seventh or odd chamber operating as a changeover chamber and being at any pressure between high and low. Thus in the chamber position illustrated in FIG. 2 the axis of eccentricity defined as a line extending between the ring and star member's axes 32,28, and shown as the Y—Y axis separates high pressure chambers *b*, *c* and *d* from the low pressure chambers *e*, *f* and *g* with pressure chamber *a* being a changeover chamber at that instant. Furthermore, it will be appreciated that the Y—Y axis of eccentricity will rotate at an angular speed equal to the orbiting speed of the star member 10. Thus when the star member has orbited one tooth position in the direction of orbiting arrow 36, which represents a motor application of the geroter, the Y—Y axis will also have rotated and now will bisect roller C and pressure chamber *g;* chambers *c*, *b* and *a* being at high pressure and chambers *d*, *e* and *f* at low pressure. Thus, all volume chambers 14 lying on one side of the Y—Y axis are either expanding or contracting and all expanding and contracting volume chambers are connected by the valving to either inlet or outlet ports 4,6 in the housing respectively.

Now referring to FIGS. 3 and 4, it will be seen that the circular pockets 16 in ring member 12 are defined by a radius R nominally larger than the radius R′ of the rollers 18. Each pocket's configured surfaces includes a pair of axially-extending recesses 20 symmetrically spaced from the pocket centerline 34 and shown as having a rectangular configuration defined by inner, outer and rearward edge surfaces 31,33,35. Recesses 20 are separated from one another between their inner edge surfaces 31 by an arcuate roller support surface or land 22 and communicate with one another by means of grooves or depressed areas 24 shown extending around the roller support surface 22. Extending from the outer edge surface 31 of each recess 20 and opening to the internal periphery of ring member 12 is a pocket leading edge support surface 38 which is in radial alignment with roller support surface 22. In the embodiment shown, tests have indicated that an included angle X of at least 120° between centers of recesses 20 having effective peripheral widths intercepting arcs Y of at least 30° results in an efficient balancing arrangement. It will be appreciated that the position and configuration of lands 22 and depressed areas 24 can be varied to provide geometric configurations other than that shown, whereby recesses 20 can communicate with one another.

The position of roller D within its pocket 16 is believed to result partly from the direction of the contact force exerted on roller D by its mating star tooth 26 as will now be described in detail with reference to roller-pocket configurations of the present invention shown in FIG. 4 and that of the prior art shown in FIG. 5 wherein like numbers designated by a prime (') indicate like parts where applicable. In both figures the geometric arrangements are similar in that a cylindrical roller D, D' is disposed within an oversized cylindrical pocket 16,16'. Importantly the position of the roller within its pocket determines the placement of the line of tangency between the roller and pocket surface which by definition establishes line-to-line contact between roller and pocket.

Thus in the prior art shown in FIG. 5, fluid under high pressure from volume chamber d' enters into the clearance Z' at one end between pocket and roller and exerts a gradient hydrostatic pressure between pocket and roller, with the clearance approaching zero at the line of tangency. The position of the line of tangency in turn is determined by the direction and magnitude of the resultant force of the hydrostatic pressure, and the resultant contact force between star tooth and roller. Importantly the direction of the contact force changes as the star member moves relative to the ring member and the line of tangency moves proportionately (i.e., compare tooth contact of roller D with that of roller C in FIG. 2 to determine limits of roller-star tooth contact for roller D,D'). Thus the peripheral portion of roller D' over which a constant hydrostatic force is exerted, increases and decreases as the star member moves relative to the ring member. The peripheral force distribution thus shown vectorially in FIG. 5 for an instantaneous position of star tooth contact represents a summation of the gradient and constant hydraulic pressure over the roller surface which resolves itself into a changing resultant balancing force 42' of higher magnitude having a larger, lateral force component and a much smaller balancing component in the Y—Y direction than that which is obtained in the present invention. In the prior art the risk exists of the resultant force 42' taking a direction which results in an outward directed "balancing" force in the Y—Y direction. In such case, contact or sealing is lost between the star and roller members.

In accordance with the present invention, the tangency line of contact is constantly maintained at the leading edge support surface 38 adjacent low pressure volume chamber *e* because fully hydrostatic pressure is communicated through clearance Z (normally between .0005 inches (.0127mm) to .0010 inches (.0254mm) as shown) to each recess 20 by lands 24. More particularly, if the tangency line tends to be positioned between recesses 20 because of star tooth loading, the hydrostatic pressure in that recess 20 and that portion of land 24 adjacent the peripheral portion of roller D which would otherwise be sealed is sufficient to bias roller D inwardly to establish hydrostatic pressure between the roller and pocket surfaces. This is more clearly shown by the vectorial peripheral force distribution shown in FIG. 4 which represents a summation of the pressures acting axially along the depth of roller D. The force distribution shown is essentially a uniform radial load extending around the periphery of roller D from the recess 20 closest low pressure volume chamber *e* and a gradient radial load in the support surface 38 and resolves itself into a constant resultant force 42 of lesser magnitude but much better orientation than the resultant force 42' of the prior art.

To complete the force analysis, it should be noted that in both FIGS. 4 and 5, a bearing lubricating film exists between the leading edge support surface 38, 38' adjacent low pressure chamber *e*, *e'* and the pocket. This film may develop a hydrodynamic force upon rotation of roller D,D' although such force, if developed, is considered insignificant when compared to the hydrostatic forces.

The resultant force 42 in the present invention thus sufficiently biases the star member 10 downwardly forcing tooth contact to occur at points 44,46 on rollers G and A respectively. High pressure chambers *b*, *c* and *d* are thus sealed from low pressure chambers *e*, *f* and *g* and the geroter is balanced at this instant. In this connection, it will be noted that some pressure differential may occur between volume chambers *a* and *b* and *a* and *g* which will tend to displace rollers A,G within their pockets 16 in a position opposite to that shown as the pressure in changeover chamber *a* rapidly changes. However it is believed that the magnitude of the resultant force 42 is sufficient to bias rollers A, G toward the position shown. In any event if either or both of the rollers A, G were to receive any significant pressure buildup in their recesses 20, the forces developed would tend to increase the sealing effect.

It should also be noted that a pressure gradient does not exist behind rollers B, C, E, and F because the respective volume chambers on each side of these rollers are both at either high or low pressure. However, it will be noted that high pressure rollers B and C are biased into the position of roller D by the teeth of star member 10 and fluid is entrapped behind the rollers during this time. Thus when roller C is exposed to volume chambers which are at high and low pressure on each of its sides during the orbiting of the star member as explained above, the fluid behind roller C is rapidly pressurized to form the above-defined pressure pattern.

While the preferred embodiment has been explained as operating as a motor with the star member orbiting in the direction of arrow 36, it should be apparent from the symmetry of the pocket construction that the radial balancing means disclosed herein will operate satisfactorily if the orbiting motion of the star member 10 is reversed resulting in reversed motor shaft rotation. Similarly, the radial pressure balancing means, while described above in a motor application, will likewise function in a pump application.

It is also appreciated that the magnitude and direction of resultant force 42 is achieved by the particular pressure pattern established behind the roller 18 which is characterized by being symmetrically distributed about the pocket periphery between recesses 20. Thus, the symmetrical pressure distribution will not be adversely effected if a third recess is placed in line with the pocket center, although satisfactory balancing has been achieved with only two recesses.

The invention has been described with reference to a preferred embodiment. Obviously, modifications and alterations will occur to others upon reading and understanding of the specification. It is my intention to include all such modifications and alterations insofar as they come within the scope of the present invention.

It is thus the essence of my invention to provide a radial, pressure-balancing arrangement in a fluid-operated device of the geroter type which utilizes a predetermined rollerpocket recess configuration to produce a predetermined pressure gradient which effectively biases a ring-roller tooth to produce sealing engagement between the star and ring roller assembly.

Having thus defined my invention, I claim:

1. An internally-toothed member for use in a rotary fluid pressure device of the geroter type, said internally-toothed member comprising a ring member having a plurality of substantially semi-cylindrical pockets therein, a substantially cylindrical roller received in each of said pockets, each of said pockets having a configured surface including axially-extending recesses therein and roller support surfaces intermediate said recesses, said roller support surfaces defining at least one groove communicating between adjacent recesses.

2. The device of claim 1 wherein said recesses are symmetrically spaced about the centerline of said pockets.

3. Pressure-balancing means in a hydraulic device of the geroter type having an internally-toothed ring member with a plurality of spaced, axially-extending pockets formed along its internal periphery and a roller loosely disposed in each pocket to define the teeth thereof, an externally-toothed star member having less teeth than said ring member and eccentrically disposed within said ring member, said ring and said star member cooperating with one another to define increasing and decreasing volume chambers, the improvement comprising:

each of said pockets having a plurality of axially-extending recesses therein spaced symmetrically about the centerline of said pocket, and means for communicating pressure between said recesses, and said communicating means comprising at least one land between said recesses, said land adapted to support said roller and defining grooves communicating said recesses with each other.

4. The improvement of claim 3 wherein each pocket has a circular cross-sectional configuration extending beyond 180° and said recesses which comprise two in number are spaced apart from one another less than 180° to define two opposed circular leading edge support surfaces, each edge surface adjacent at one end to the internal periphery of said ring member and adjacent at its other end to a recess.

5. The improvement of claim 4 wherein said roller support surface and said leading edge surfaces are radially-aligned.

6. A rotary fluid pressure device comprising:

a housing having inlet and outlet ports;

an internally-toothed ring member disposed within said housing, and an externally-toothed star member having less teeth than said ring member and eccentrically disposed within said ring member to define a line of eccentricity passing through the axes of said members;

one of said members having a plurality of generally semi-cylindrical pockets and a generally cylindrical roller disposed within each pocket to define the teeth thereof;

said teeth of said members intermeshing as one member orbits about the axis of the other to define expanding volume chambers on one side of said line and contracting volume chambers on the other side of said line;

valving means communicating with said inlet and outlet ports to supply high pressure to those chambers on one side of said line and low pressure to those chambers on the other side of said line;

balancing means biasing a roller momentarily positioned between a volume chamber at high pressure and a volume chamber at low pressure by exerting fluid pressure about the pocket centerline in a substantially symmetrical distribution which extends over a portion of the pocket periphery;

said balancing means comprising a plurality of axially-extending recesses defined by said pocket, said recesses being symmetrically spaced about the pocket periphery in relation to the pocket centerline;

the spacing between adjacent recesses defining at least one roller support surface and at least one depressed area in said roller support surface communicating adjacent recesses with one another; and said pocket further defined by diametrically-opposed leading support edge surfaces extending from the recesses furthest-removed from the pocket centerline to the internal periphery of said ring member.

* * * * *